US009480875B2

(12) United States Patent
Delgado

(10) Patent No.: US 9,480,875 B2
(45) Date of Patent: Nov. 1, 2016

(54) ABDOMINAL EXERCISE DEVICE WITH TORSO AND LEG SUPPORT

(71) Applicant: Rey Delgado, Maspeth, NY (US)

(72) Inventor: Rey Delgado, Maspeth, NY (US)

( * ) Notice: Subject to any disclaimer, the term of this patent is extended or adjusted under 35 U.S.C. 154(b) by 0 days.

(21) Appl. No.: 14/511,849

(22) Filed: Oct. 10, 2014

(65) Prior Publication Data

US 2015/0141221 A1 May 21, 2015

Related U.S. Application Data

(60) Provisional application No. 61/889,109, filed on Oct. 10, 2013.

(51) Int. Cl.
*A63B 26/00* (2006.01)
*A63B 71/00* (2006.01)
*A63B 23/02* (2006.01)

(52) U.S. Cl.
CPC ..... *A63B 23/0211* (2013.01); *A63B 2209/00* (2013.01); *A63B 2225/09* (2013.01); *A63B 2225/093* (2013.01)

(58) Field of Classification Search
CPC A63B 21/00; A63B 21/00047; A63B 23/00; A63B 23/02; A63B 23/0205; A63B 23/0211; A63B 23/0216; A63B 23/0222
USPC ..... 482/140, 142, 145, 148, 79
See application file for complete search history.

(56) References Cited

U.S. PATENT DOCUMENTS 4,358,109 A * 11/1982 Schrems ..... A63B 21/4029 482/142
4,566,691 A * 1/1986 Mahnke ..... A63B 21/078 482/104
4,749,190 A * 6/1988 Jennings ..... A63B 23/00 482/104
5,060,939 A * 10/1991 Oswald ..... A63B 23/0494 482/137
5,176,603 A * 1/1993 Hundley ..... A63B 21/4029 482/140
5,573,485 A * 11/1996 Geschwender .... A63B 23/0233 482/112
5,997,450 A * 12/1999 Wilkinson ..... A63B 23/0211 482/121
6,030,324 A * 2/2000 McBride ..... A63B 21/072 482/142
6,645,129 B2 * 11/2003 Eschenbach ..... A63B 21/062 482/121
6,692,418 B2 * 2/2004 Shahan ..... A63B 23/02 482/143
7,591,769 B1 * 9/2009 Benjamin ..... A63B 21/068 482/131
7,857,741 B1 * 12/2010 Hsiung ..... A61H 1/0218 482/143
8,814,764 B2 * 8/2014 Vaughns ..... A63B 23/0211 482/101
2011/0301002 A1 * 12/2011 Sebastian ..... A63B 21/068 482/140
2011/0319237 A1 * 12/2011 Jones ..... A63B 21/00047 482/140

* cited by examiner

*Primary Examiner* — Loan H Thanh
*Assistant Examiner* — Garrett Atkinson
(74) *Attorney, Agent, or Firm* — The Law Office of Jerry D. Haynes

(57) ABSTRACT

An abdominal exercise device comprising a body support to support an upper body of a user, where the body support includes a back rest made up of cushioned partitions; a pair of handles attached to the back rest; a track extending from an end of the body support, where the track includes a plurality of adjustment holes; a leg support attached to the track with a sleeve, where the leg support is adjustable along the track by fastening a stopper through one of the adjustment holes; a slide extending from the sleeve, where the slide includes a plurality of adjustment holes; and a leg stabilizer attached to the slide with a sleeve, where the leg stabilizer is adjustable along the slide by fastening a stopper through one of the adjustment holes.

7 Claims, 1 Drawing Sheet

ABDOMINAL EXERCISE DEVICE WITH TORSO AND LEG SUPPORT

CROSS REFERENCE TO OTHER APPLICATIONS

This application claims priority to U.S. Provisional Application Ser. No. 61/889,109 filed on Oct. 10, 2013.

BACKGROUND OF THE INVENTION

1. Field of the Invention

The present invention relates an abdominal exercise device that provides leg support for users using same.

2. Description of Related Art

Individuals often perform abdominal exercises to strengthen and reduce the size of their abdomen area. In order to effectively execute abdominal exercises (e.g. sit ups and crunches) individuals typically lie on their backs and with the help of another person to hold their legs, lift their upper torso off the floor by contracting their lower abdominal muscles. It is uncomfortable for many individuals to lie on their backs when carrying out abdominal exercises; individuals who have back problems, who are out of shape, and those who are overweight have great difficulty and may even find abdominal exercises off-putting because of the position they must partake. Furthermore, finding someone to hold your legs is not always possible or may be a source of embarrassment for some individuals. This is problematic for individuals those who would like to strengthen their abdomen because they must resort to doing so in uncomfortable positions and without any leg support.

Therefore, it would be desirable in the art to provide an abdominal exercise device that provides support for both the user's legs and torso.

SUMMARY OF THE INVENTION

In view of the foregoing disadvantages inherent in the prior art, the general purpose of the present invention is to provide an abdominal exercise device to perform abdominal exercises, configured to include all of the advantages of the prior art, and to overcome the drawbacks inherent therein.

Accordingly, an object of the present invention is to provide an abdominal exercise device with a back rest and leg support to uphold a user's legs while also providing a comfortable back cushion.

Another object of the present invention is to provide an abdominal exercise device where the leg support is adjustable in both distance from the back rest and the height of the foot stabilizer thereby providing positions for a variety of exercises.

To achieve the above objects, in an aspect of the present invention, an abdominal exercise device is described comprising a body support to support an upper body of a user, where the body support includes a back rest made up of cushioned partitions; a pair of handles attached to the back rest; a track extending from an end of the body support, where the track includes a plurality of adjustment holes; a leg support attached to the track with a sleeve, where the leg support is adjustable along the track by fastening a stopper through one of the adjustment holes; a slide extending from the sleeve, where the slide includes a plurality of adjustment holes; and a leg stabilizer attached to the slide with a sleeve, where the leg stabilizer is adjustable along the slide by fastening a stopper through one of the adjustment holes.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DRAWINGS

The present invention relates to an abdominal exercise device with upper back, lower back, and leg supports; the aforementioned three supports effectively assist the user when performing abdominal exercises. The supports are cushioned and may be ergonomically shaped for a safe and comfortable feel. The leg support may be raised and lowered along a slide to adjust the height of the user's legs while performing the abdominal exercises. The abdominal exercise device may include handles on each side of the back rest for added leverage and grip, and additionally a headrest for added neck and head support. With the abdominal exercise device, individuals are afforded with necessary torso and leg support for effectively performing abdominal exercises.

Figure 1:
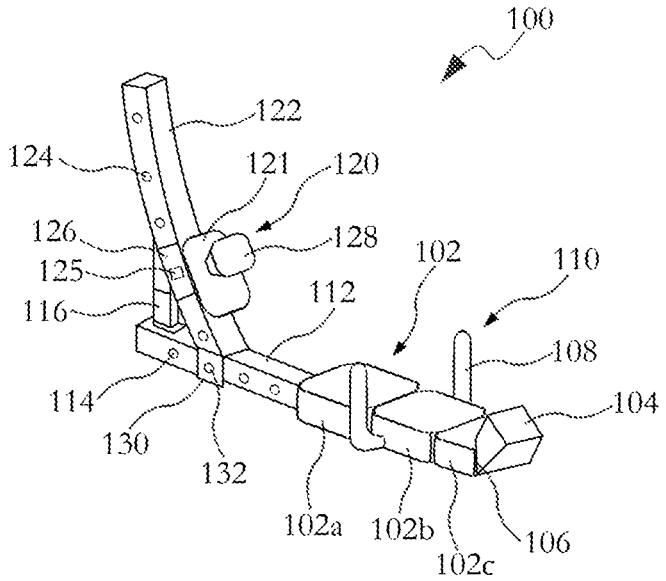
FIG. 1 depicts a perspective view of an abdominal exercise device in accordance with an exemplary embodiment of the present invention.

Turning now descriptively to the drawings, referring to FIG. 1, a perspective view of an abdominal exercise device 100 is shown in accordance with an exemplary embodiment of the present invention. The abdominal exercise device 100 comprises an upper body support 110, and a leg support 120. The upper body support 110 comprises a back rest 102 including a lower torso support 102*a*, a middle support 102*b* and an upper torso support 102*c*. The back rest 102 may be individually partitioned so that the padding of the lower 102*a*, middle 102*b*, and upper 102*c* supports are ergonomically shaped for the body.

Attached to the upper support 102*c* may be a head rest 104. The head rest 104 may be adjustable on a pivot 106 that allows a user to adjust the angle of the head rest 104 as needed for comfort. The back rest 102 and the head rest 104 may be filled with padding and then covered with a waterproof cover that prevents sweat and moisture from ruining the padding. Attached to the back rest 102, preferably between the lower support 102*a* and the middle support 102*b*, may be a pair of handles 108. The handles 108 allow the user to brace themselves upon the body support 110 as they exercise. The handles 108 may be textured or covered with a non-slip material to ensure that the user maintains their grip.

The body support 110 is attached to a track 112 at an opposite end from the head rest 104. The track 112 extends from back rest 102 and includes a plurality of adjustment holes 114. The track 112 may be a hollow, elongated, square tube so that it is lightweight and portable. The track 112 may be made from steel, aluminum, plastic or the like able to withstand the weight of the user while working out while still being portable for use and storage.

The leg support 120 may be attached along the track 112 with a sleeve 130. The sleeve 130 fastens into one of the plurality of adjustment holes 114 with a stopper 132. The sleeve 130 allows the leg support 120 to move away and toward the body support 110 along the track 112. Behind the leg support 120 may be a telescopic brace 116 that further supports the leg support 120. The telescopic brace 116 is adjustable to be continuously in contact with the leg support 120.

The leg support 120 includes a slide 122 with a leg stabilizer 121 that is attached on a second sleeve 126. The slide 122 may rise at a curved angle from the track 112 up to a 90 degree angle from the track 112. The second sleeve 126 fastens the leg stabilizer 121 at various heights along the slide 122. The leg stabilizer 121 is held in place with a stopper 125 that is threaded through one of a plurality of adjustment holes 124 along the slide 122. The leg stabilizer 121 holds the user's legs at various heights while the abdominal exercise device 100 is being used. Atop the leg stabilizer 121 may be a foot pad 128 upon which the user may position their feet while performing the abdominal exercises. The foot pad 128 may be padded and covered with a waterproof material similar to the back rest 102 of the body support 110.

Figure 2:
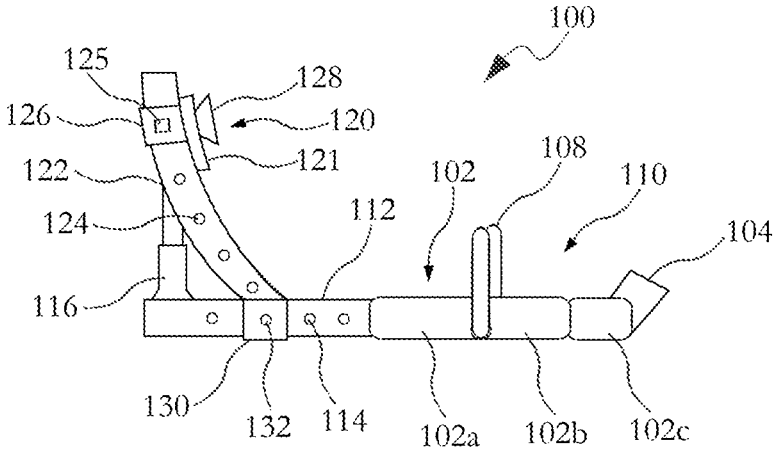
FIG. 2 depicts a side view of an abdominal exercise device in accordance with an exemplary embodiment of the present invention.

Referring now to FIG. 2, a side view of the abdominal exercise device 100 is shown in accordance with an exemplary embodiment of the present invention. The track 112 is adjustable within the back rest 102 to accommodate users of varying heights, and to create a compact embodiment when the abdominal exercise device 100 is not in use. During use, the user may lay comfortably on the device 100 by placing their back on the corresponding lower, middle and upper supports 102*a*, 102*b*, 102*c* and positioning their legs against the leg stabilizer 121 of the leg support 120. Further, the user of the abdominal exercise devise 100 may elect the angle in which they would like their legs to be raised by engaging the leg stabilizer 121 along the slide 122. By lastly contracting their lower abdominal muscles and lifting their upper body, individuals may accomplish an effective and proper abdominal exercise with the abdominal exercise device 100.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

What is claimed is:

1. An abdominal exercise device comprising:

a. an upper body support adapted to support an upper body of a user in an horizontal position, where the upper body support includes a back rest made up of cushioned partitions;

b. a pair of handles attached to the back rest, wherein the pair of handles includes a handle extending from each side of the back rest;

c. a track extending from an end of the body support, where the track includes a plurality of adjustment holes;

d. a leg support attached to the track with a first sleeve, where the leg support is adjustable along the track by fastening a first stopper through one of the adjustment holes, and said leg support extends vertically from the track;

e. a slide incorporated in the leg support, the slide rising at a curved angle from the track up to a 90 degree angle from the track, where the slide includes a plurality of adjustment holes; and f. a leg stabilizer attached to the slide with a second sleeve, where the leg stabilizer is adjustable along the slide by fastening a second stopper through one of the adjustment holes.

2. The abdominal exercise device according to claim 1, where the back rest includes a lower support, a middle support, and an upper support.

3. The abdominal exercise device according to claim 1, where the back rest is padded and covered with a waterproof material.

4. The abdominal exercise device according to claim 1, where the upper body support includes a head rest attached to an end of the back rest opposite the track.

5. The abdominal exercise device according to claim 4, where the head rest is attached via a pivot, where the pivot adjusts an angle of the head rest.

6. The abdominal exercise device according to claim 1, where the leg stabilizer includes a foot pad.

7. The abdominal exercise device according to claim 1, where the pair of handles are textured for a non-slip grip.

* * * * *